US008500301B2

(12) United States Patent
Duan

(10) Patent No.: US 8,500,301 B2
(45) Date of Patent: Aug. 6, 2013

(54) ILLUMINANT DEVICE AND MANUFACTURING METHOD OF LAMP HOLDER

(75) Inventor: Qiang-Fei Duan, Hui Zhou (CN)

(73) Assignee: Cooler Master Co., Ltd., New Taipei (TW)

( * ) Notice: Subject to any disclaimer, the term of this patent is extended or adjusted under 35 U.S.C. 154(b) by 0 days.

(21) Appl. No.: 13/347,858
(22) Filed: Jan. 11, 2012
(65) Prior Publication Data

US 2013/0114251 A1 May 9, 2013

(30) Foreign Application Priority Data

Nov. 7, 2011 (TW) ..... 100140616 A

(51) Int. Cl.

| | |
|---|---|
| ***F21V 1/00*** | (2006.01) |
| ***F21V 21/00*** | (2006.01) |
| ***F21V 11/00*** | (2006.01) |
| ***H01J 5/48*** | (2006.01) |
| ***H01J 5/50*** | (2006.01) |
| ***F21S 4/00*** | (2006.01) |

(52) U.S. Cl.
USPC ..... 362/235; 362/249.01; 313/318.01

(58) Field of Classification Search
USPC ..... 174/252, 256; 313/113, 318.01, 313/634, 493, 623; 362/249.01, 249.02, 362/294, 296.01, 317, 341, 351, 355, 356, 362/362, 363, 364, 365, 373, 374
See application file for complete search history.

(56) References Cited

U.S. PATENT DOCUMENTS

| | | | | |
|---|---|---|---|---|
| 7,780,315 | B2 * | 8/2010 | Gasquet et al. | 362/294 |
| 7,819,562 | B2 * | 10/2010 | Freeman et al. | 362/374 |
| 7,942,540 | B2 * | 5/2011 | Harbers et al. | 362/84 |
| 2009/0175041 | A1 * | 7/2009 | Yuen et al. | 362/294 |
| 2011/0101841 | A1 * | 5/2011 | Qin | 313/46 |

* cited by examiner

*Primary Examiner* — Jong-Suk (James) Lee
*Assistant Examiner* — Alexander Garlen
(74) *Attorney, Agent, or Firm* — Chun-Ming Shih; HDLS IPR Services

(57) ABSTRACT

An illuminant device includes at least an illuminant element and a lamp holder including a housing, a metal core printed circuit board (MCPCB) and a power-driving unit. The housing includes a first side and a second side opposite to the first side. The MCPCB is disposed on the first side of the housing and includes a base and a plurality of extending parts extended from the circumference of base in a bending forming manner and spaced from each other. The base has a plurality of holes, the extending parts are embedded within the housing, and the illuminant element is mounted on the base. The power-driving unit includes a circuit board, and a first end of the circuit board has a plurality of posts. The posts are respectively penetrated the holes and electrically connected to the MCPCB. In addition, a manufacturing method of the lamp holder is disclosed.

18 Claims, 17 Drawing Sheets

ILLUMINANT DEVICE AND MANUFACTURING METHOD OF LAMP HOLDER

BACKGROUND OF THE INVENTION

1. Field of the Invention

The present invention relates to an illuminant device, especially to an illuminant device with high thermal conductivity coefficient and insulating property and uses light emitting diodes as light source.

2. Description of Prior Art

Light emitting diodes (LEDs) have the advantages of small volume, long lifetime, difficulty damage, without mercury and lower power consumption. They are gradually replacing the fluorescent tubes and incandescent lamps and widely used in indoor or outdoor lighting and decorative lighting.

Reference is made to FIG. 1, which is a cross-sectional view of a conventional LED lamp. The LED lamp includes a housing 50, a circuit board 52, a plurality of LEDs 54, a conductive connector 56, a shell 58 and a power driving unit 59. The housing 50 is a hollow body and has a plurality of fins 51 radially extended from a circumferential wall and physically connected thereon, thereby the heat-dissipation area of the housing 50 is increased and can quickly remove heat generated by the LEDs 54 to the air. The circuit board 52 is disposed on the housing 50 and electrically connected to the power circuit unit 59 through multiple wires 53. The LEDs 54 are disposed on the circuit board 52 and electrically connected thereto. The conductive connector 56 is physically connected to the housing 50 at the location opposite to the circuit board 52, and electrically connected to the power driving circuit 59 through two power lines 57. The shell 58 is disposed on the housing 50 at the side disposed the LEDs 54 such that the LEDs 54 are arranged between the shell 58 and the housing 50.

However, the circuit board 52 and the conductive connector 56 are electrically connected to the power driving unit 59 through the wires 53 and the power lines 57, respectively. This increases productive processes, the difficulty of manufacturing and cost.

SUMMARY OF THE INVENTION

It is an object of the present invention to provide an illuminant device, the illuminant device has advantages of easily manufacture, lower manufacturing cost, light and high insulating property.

It is another object of the present invention to provide a manufacturing method of a lamp holder which can easily productive processes and lower manufacturing cost.

Accordingly, the illuminant device according to one aspect of the present invention comprises at least an illuminant element and a lamp holder. The lamp holder includes a housing, a metal core printed circuit board (MCPCB) and a power driving circuit. The housing has a first side and a second side opposite to the first side. The MCPCB is disposed on the first side and includes a base and a plurality of extending parts extended from a circumference of base in a bending forming manner and spaced from each other. The base has a plurality of holes, the extending parts are embedded within the housing, and the illuminant element is mounted on the base. The power-driving unit includes a circuit board, and a first end of the circuit board has a plurality of posts. The posts are respectively penetrating the holes and electrically connected to the MCPCB.

Accordingly, the manufacturing method of a lamp holder according to another aspect of the present invention comprises: assembling a plurality of holes of a MCPCB and a plurality of posts of a circuit board of a power driving unit, respectively, and electrically connecting the MCPCB and the circuit board; forming a housing outside the MCPCB and the power driving unit and partially covering the MCPCB and the power driving unit.

In the present invention, the circuit board of the power driving unit is directly assembled to the MCPCB, thereby can effectively easily productive processes and lower manufacturing cost.

BRIEF DESCRIPTION OF DRAWING

The features of the invention believed to be novel are set forth with particularity in the appended claims. The invention itself however may be best understood by reference to the following detailed description of the invention, which describes certain exemplary embodiments of the invention, taken in conjunction with the accompanying drawings in which:

DETAILED DESCRIPTION OF THE INVENTION

Figure 1:
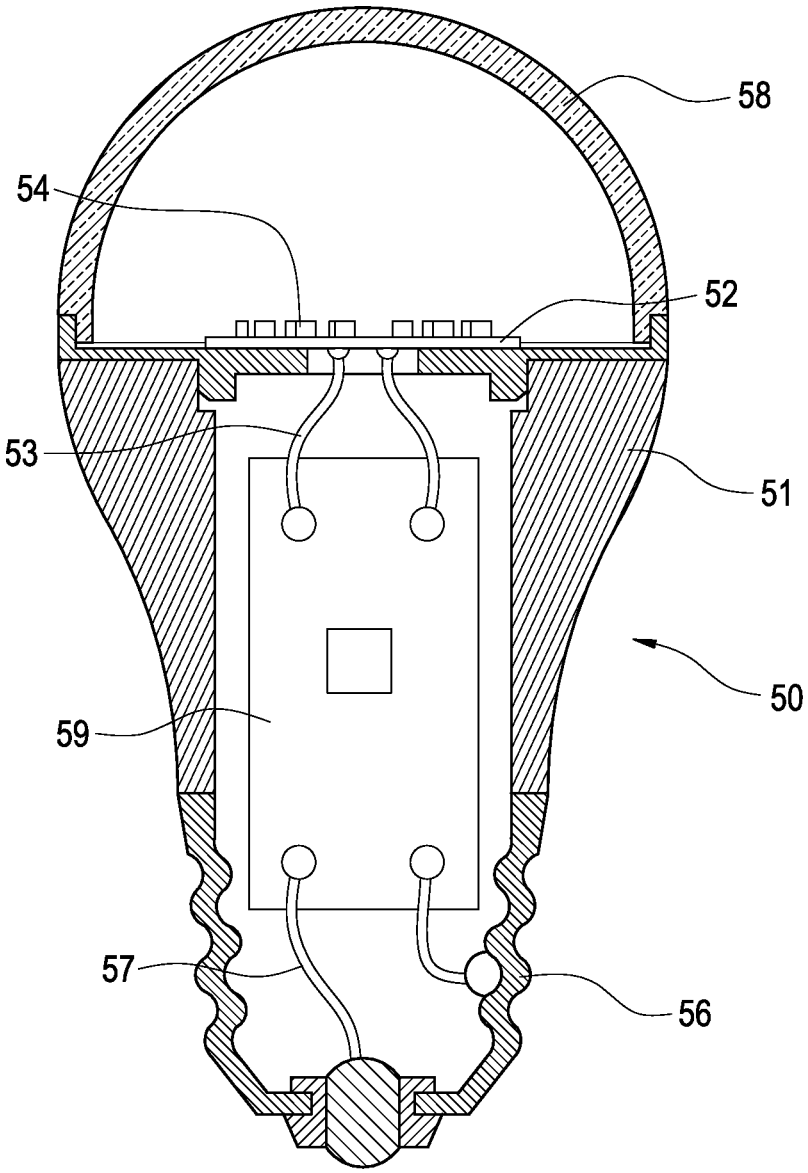
FIG.1 PRIOR ART
FIG. 1 is a cross-sectional view of a conventional light emitting diode (LED) lamp.

Reference will now be made in detail to the present embodiments of the invention, examples of which are illustrated in the accompanying drawings. Wherever possible, the same reference numbers are used in the drawings and the description to refer to the same or like parts.

Figure 2:
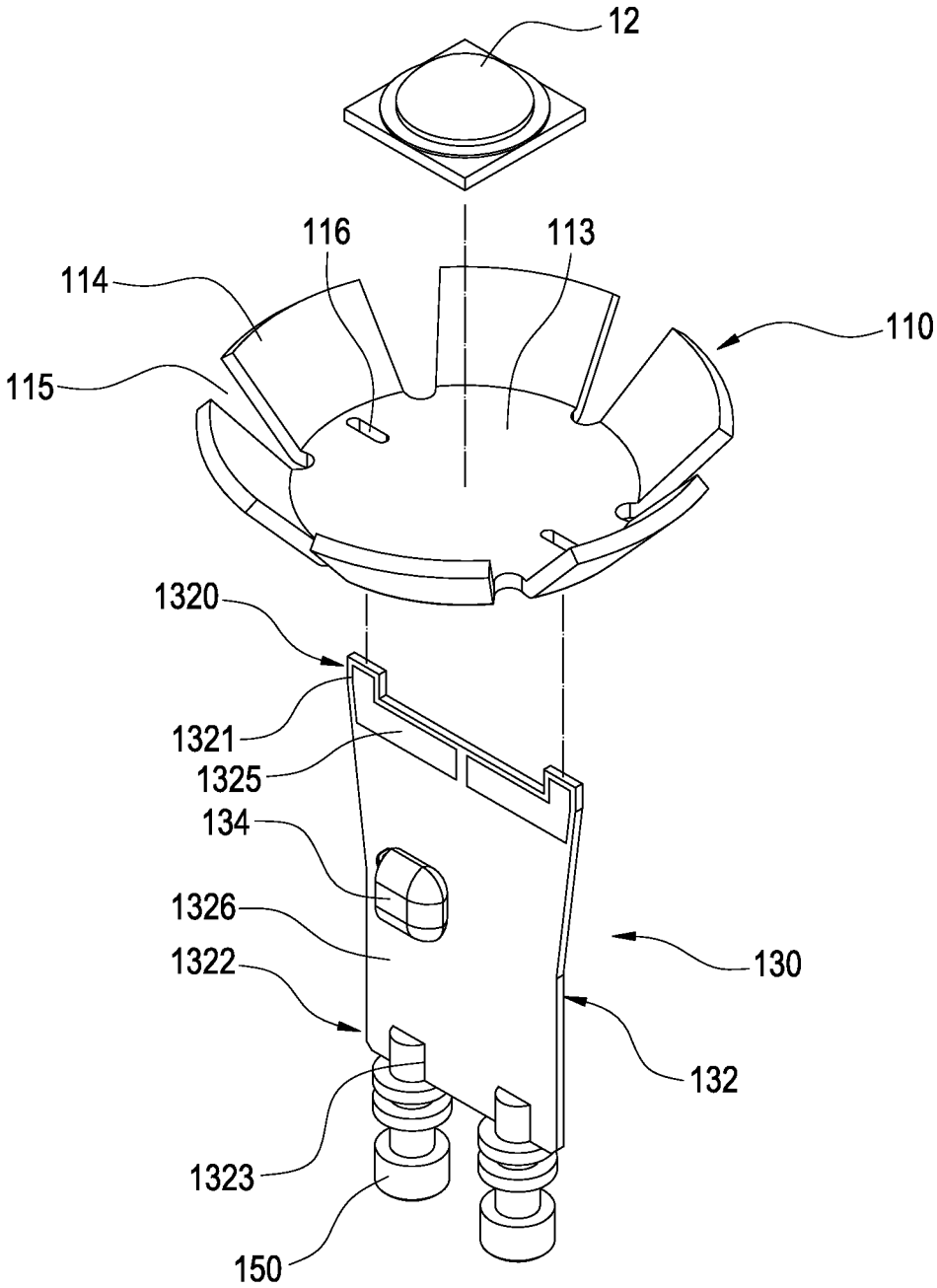
FIG. 2 is a partially exploded of an illuminant device according to a first preferred embodiment of the present invention.
Figure 3:
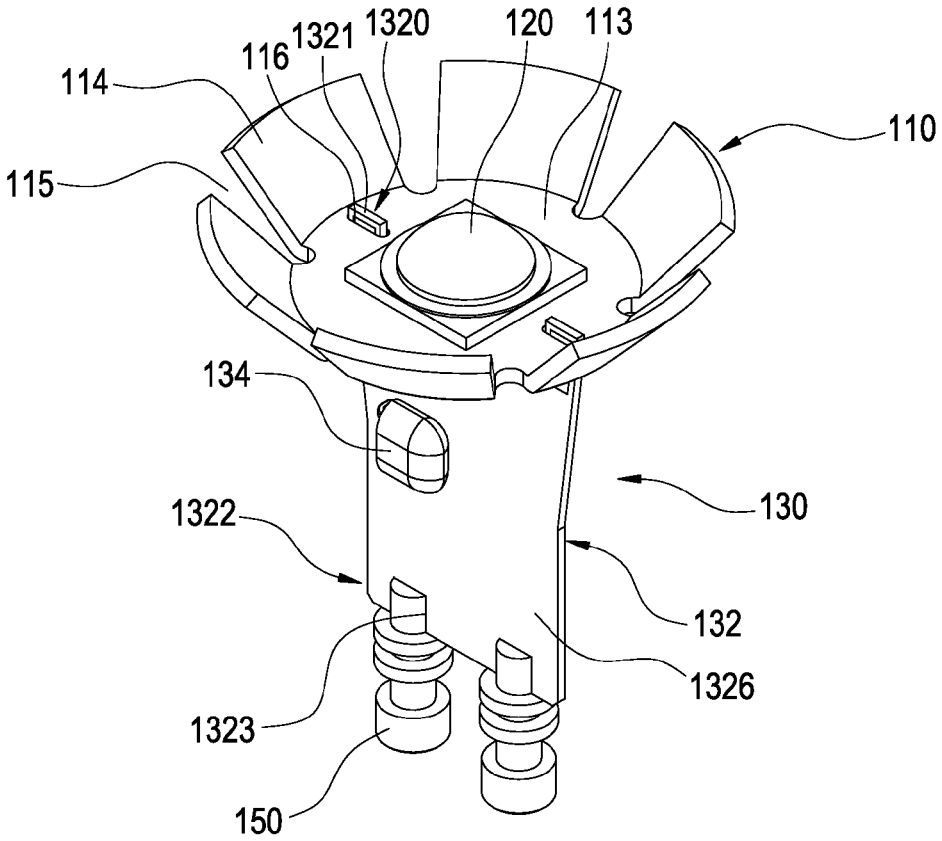
FIG. 3 is a partially assembled view of the illuminant device according to the first preferred embodiment of the present invention.
Figure 4:
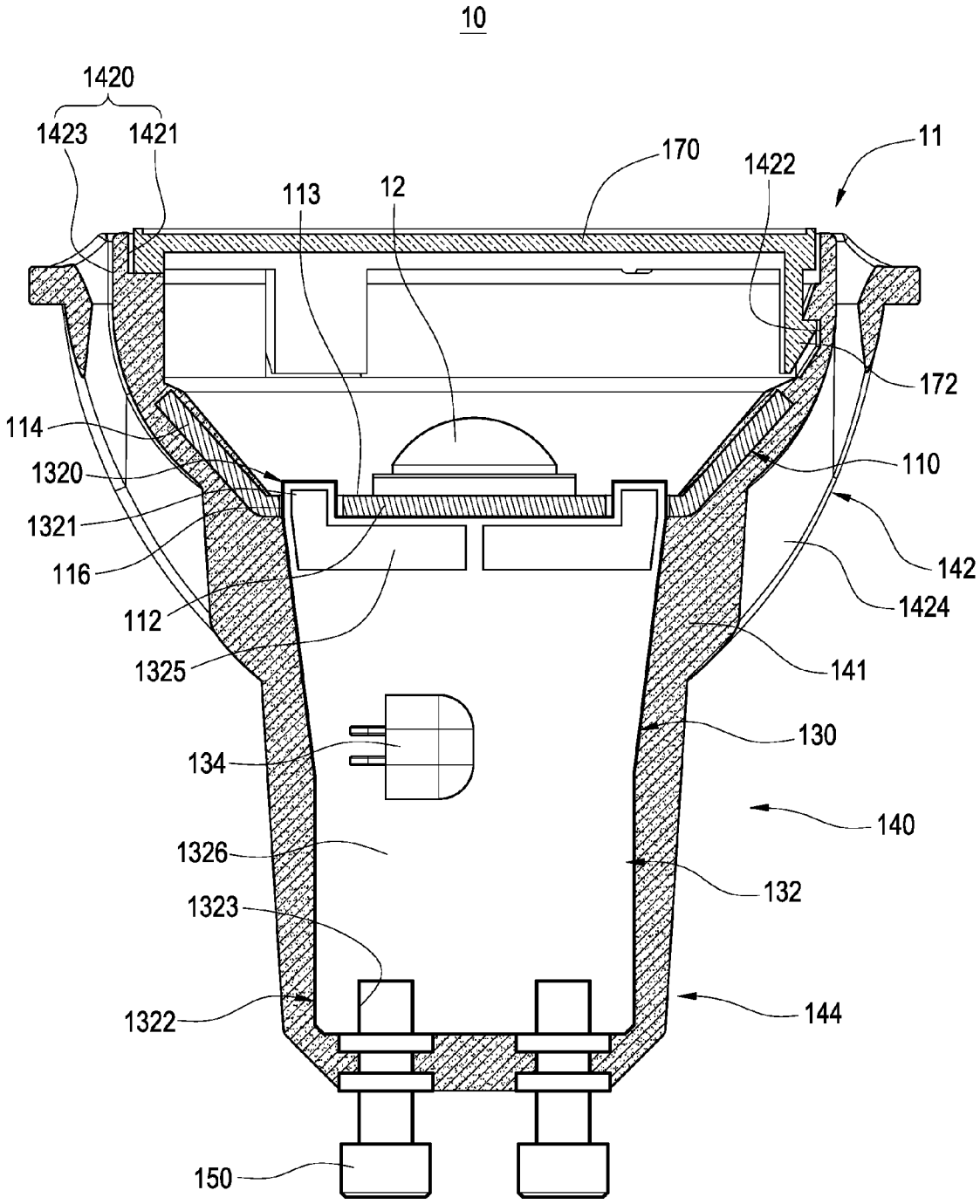
FIG. 4 is a cross-sectional view of the illuminant device according to the first preferred embodiment of the present invention.

Reference is made to FIG. 2, FIG. 3 and FIG. 4, which are respectively a partially exploded view, a partially assembled view and a cross-sectional view of an illuminant device according to a first preferred embodiment of present invention. In this embodiment, the illuminant 10 is, for example, a GU10 lamp. However, in the practical application, the illuminant device 10 may be PAR series lamp, A19, A20, A60, G30 or other type lamps. The illuminant device 10 includes a lamp holder 11 and at least an illuminant element 12. The lamp holder 11 includes a metal core printed circuit board (MCPCB) 110, a power driving unit 130 and a housing 140.

The MCPCB 110 has better thermal conductive and is provided with conductive traces (not shown) and soldering pads (not shown). The MCPCB 110 includes a base 112 and a plurality of extending parts 114 extended from a circumference of base 112 in a bending forming manner and spaced from each other. The base 112 includes a plurality of holes 116, and in this embodiment, the holes 116 are, for example, two. In the practical application, the MCPCB 110 is provided with a plurality of slots 115 by stamping process and then bended along the slots 115 such that the profile of the MCPCB 110 is of poculiform shape (cup-shaped).

The illuminant element 12 is mounted on the MCPCB 110, and in more particularly, the illuminant element 12 is mounted on an upper surface 113 of the base 112 and electrically connected to the MCPCB 110. The number of the illuminant element 12 may be one or more, and in this embodiment, the number of the illuminant element 12 is, for example, one, and preferably high power light emitting diode (LED).

The power driving unit 130 includes a circuit board 132 and at least an electronic element 134 mounted on the at least a plate 1326 of the circuit board 132. The circuit board 132 is preferably a printed circuit board (PCB) and provided with conductive traces 1325 and soldering pads (not shown). In this embodiment, the conductive traces 1325 are, for example, two. The circuit board 132 includes a first end 1320 and a second end 1322 opposite to the first end 1320. The first end 1320 has a plurality of posts 1321 corresponding to the holes 116. In this embodiment, the posts 1321 are, for example, two, and corresponding to two holes 116, respectively.

The posts 1321 are protruded the holes 116 such that the plate 1326 is substantially perpendicular to the upper surface 113 of the MCPCB 110, and the conductive traces 1325 is electrically connected to the MCPCB 110 through the posts 1321. The MCPCB 110 and the circuit board 132 may electrically connect through welding process or coating with conductive adhesive. In addition, the conductive traces 1325 may just dispose on a plane 1326 of the circuit board 132, or simultaneously dispose on two planes 1326 of the circuit board 132 and the conductive traces 1325 at one of the planes 1326 is insulated by an insulating element, such as insulating tape, thereby to prevent from short. In this embodiment, the second end 1322 of the circuit board 132 includes a plurality of concaves 1323 used for disposing two conductive pins 150 of the illuminant device 10. The conductive pins 150 are electrically connected to the power driving unit 130.

The housing 140 is made of polymer material with high thermal conductivity, such as thermoset plastic or thermoplasticity plastic, and is integrally-formed by injection molding. The housing 140 has advantages of light, easily manufacturing and high insulating effect. In addition, the polymer material includes a plurality of thermal conductive particles 141, such as metallic oxide powder, graphite powder or ceramic powder, which can effectively remove heat generated by the illuminant element 12.

Figure 5:
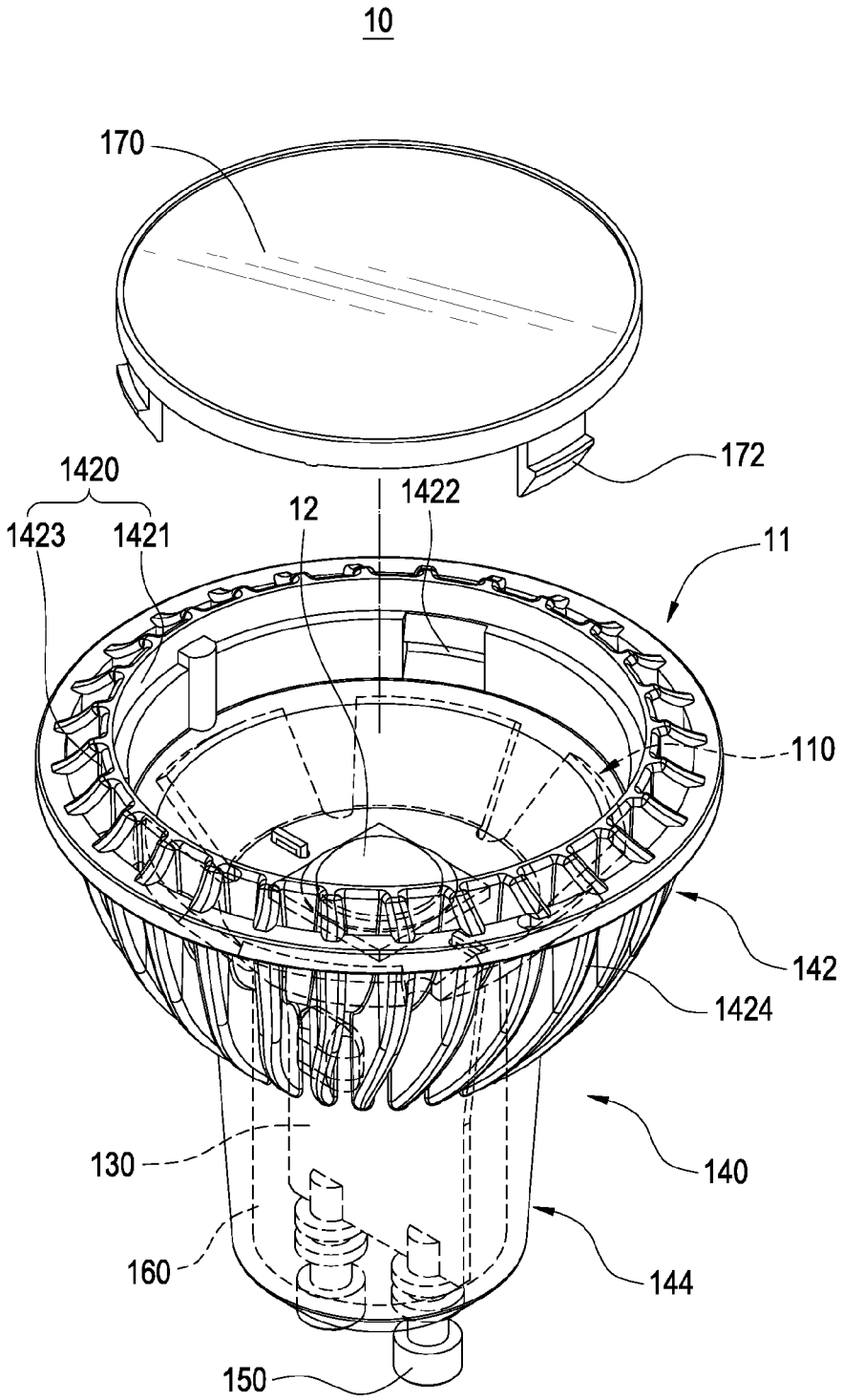
FIG. 5 is an exploded view of the illuminant device according to the first preferred embodiment of the present invention.

With reference to FIG. 4 and FIG. 5, the housing 140 has a first side 142 and a second side 144 opposite to the first side 142. The first side 142 is substantially of poculiform profile and has a circumferential wall 1420. An inner surface 1421 of the circumferential well 1420 has a plurality of grooves 1422, and an external surface 1423 of the circumferential wall 1420 has a plurality of fins 1424 radially extended therefrom and physically connected thereon to increase the effect of heat-dissipation. The fins 1424 are integrally-formed on the circumferential wall 140 and also have the thermal conductive particles 141. The fins 1424 are used to increase the heat-dissipation area so as to increase the effect of heat-dissipation. The MCPCB 110 is disposed on the first side 142 and the extending parts 114 are embedded within the housing 140. The second side 144 is physically connected to the first side 142 and is substantially of pipe shape. The conductive pins 150 pass through the bottom of the second side 144 and adapted to the external socket (not shown).

The process of manufacturing the illuminant device 10 is described as below: first, forming a plurality of slots 115 spaced from each other on the MCPCB 110 by stamping process and bending the MCPCB along the slots 115 to form a base 112 and a plurality extending parts 114, and forming a plurality of holes 116 on the base 112 in the meanwhile. Moreover, assembling a plurality of posts 1321 of a circuit board 132 of a power driving unit 130 with the holes 116 of a MCPCB 110 and electrically connected the MCPCB 110 and the circuit board 132.

After that, embedding the assembled MCPCB 110 and the power driving unit 130 into an injection mold, and forming a housing 140 outside the MCPCB 110 and the power driving unit 130. Therefore the housing 140 can directly cover the extending parts 114 of the MCPCB 110 and the power driving unit 130, such that the joining force is increased to prevent break from compression, and the heat generated by the illuminant element 12 is quickly transmitting to the housing 140 through the extending parts 114 and then dissipating to the air. Finally, mounting at least an illuminant element 12 on the MCPCB 110 and electrically connecting to the MCPCB 110 by welding process. Alternatively, the illuminant element 12 may be mounted on the housing 140 by welding process first, and then embedding the assembled MCPCB 110 mounted on the illuminant element 12 and the power driving unit 130 into an injection mold and forming the housing 140 covering the extending parts 114 of the MCPCB 110 and the power driving unit 130.

In addition, the thickness of the circuit board 132 is far smaller than its width. In order to prevent the thickness of housing 140 over-thick, a filling member 160 (as shown in FIG. 5) is disposed on both side of the circuit board 132 before injection. The filling member 160 may be, for example, a plastic member, silicone or epoxy. After that, the thickness of the housing 140 is uniform and can effectively prevent the housing 140 from deforming and lower the manufacturing cost.

The illuminant device 10 further includes a diffusing element 170, the diffusing element 170 is disposed on the first side 142 of the housing 110 and covers the illuminant element 12. The diffusing element 170 includes a plurality of buckles 172, the buckles 172 are engaged with the grooves 1422, respectively, such that the diffusing element 170 is above the illuminant element 12. The diffusing element 170 diffuses light passing through and improves the uniformity of light, therefore the illuminant device 10 can obtain optimal flare quality.

Figure 6:
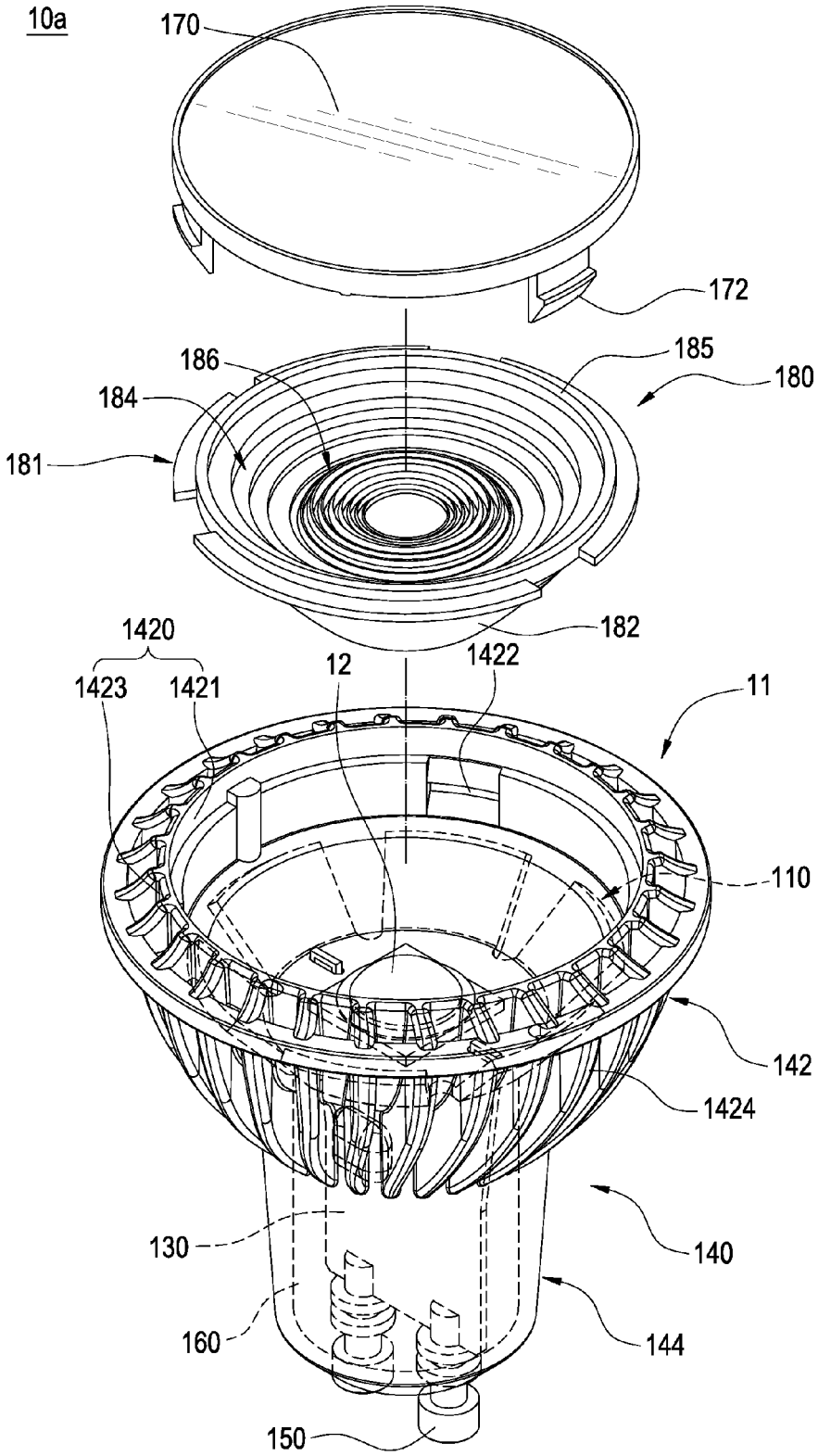
FIG. 6 is an exploded view of an illuminant device according to a second preferred embodiment of the present invention.
Figure 7:
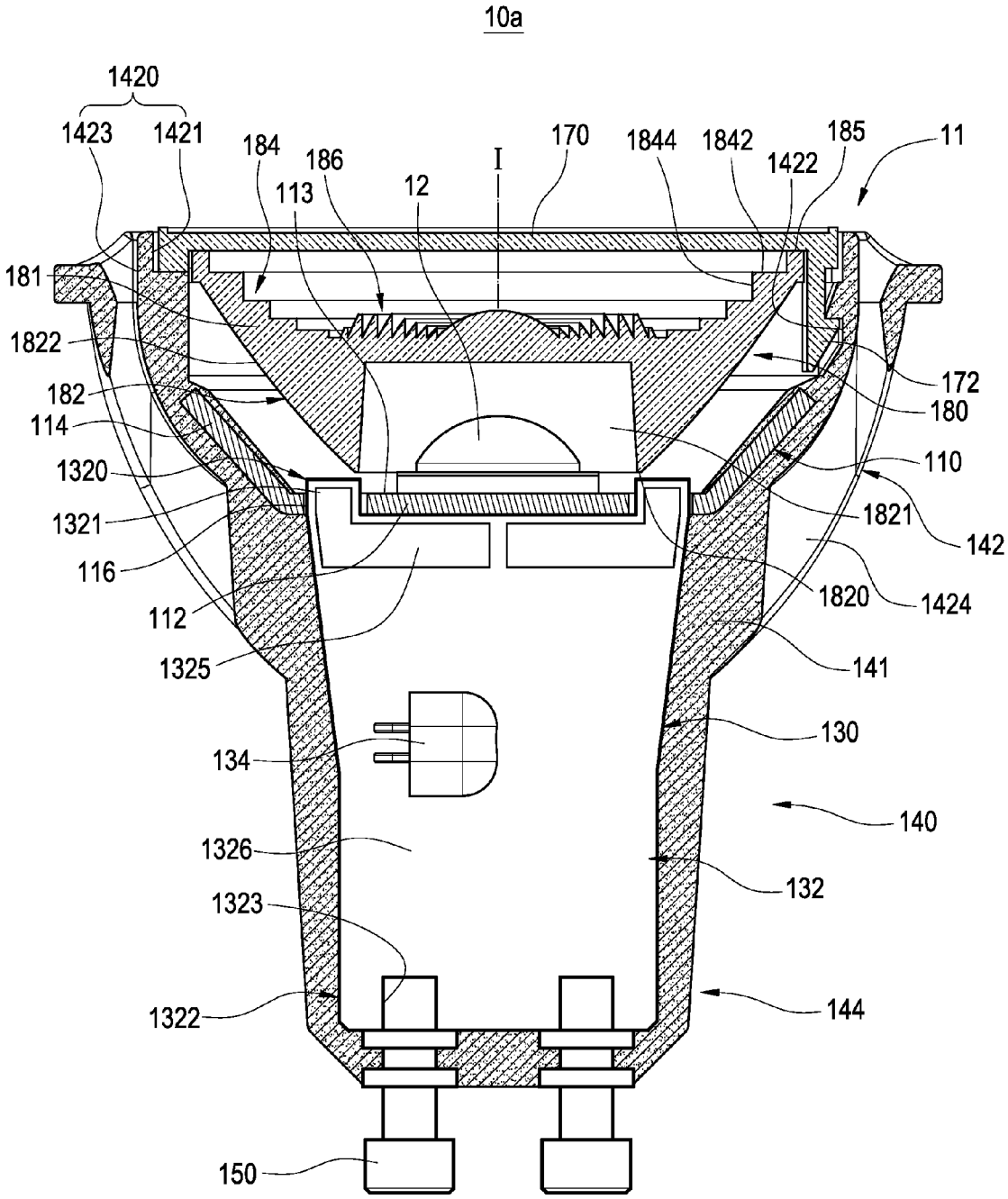
FIG. 7 is a cross-sectional view of the illuminant device according to the second preferred embodiment of the present invention.
Figure 8:
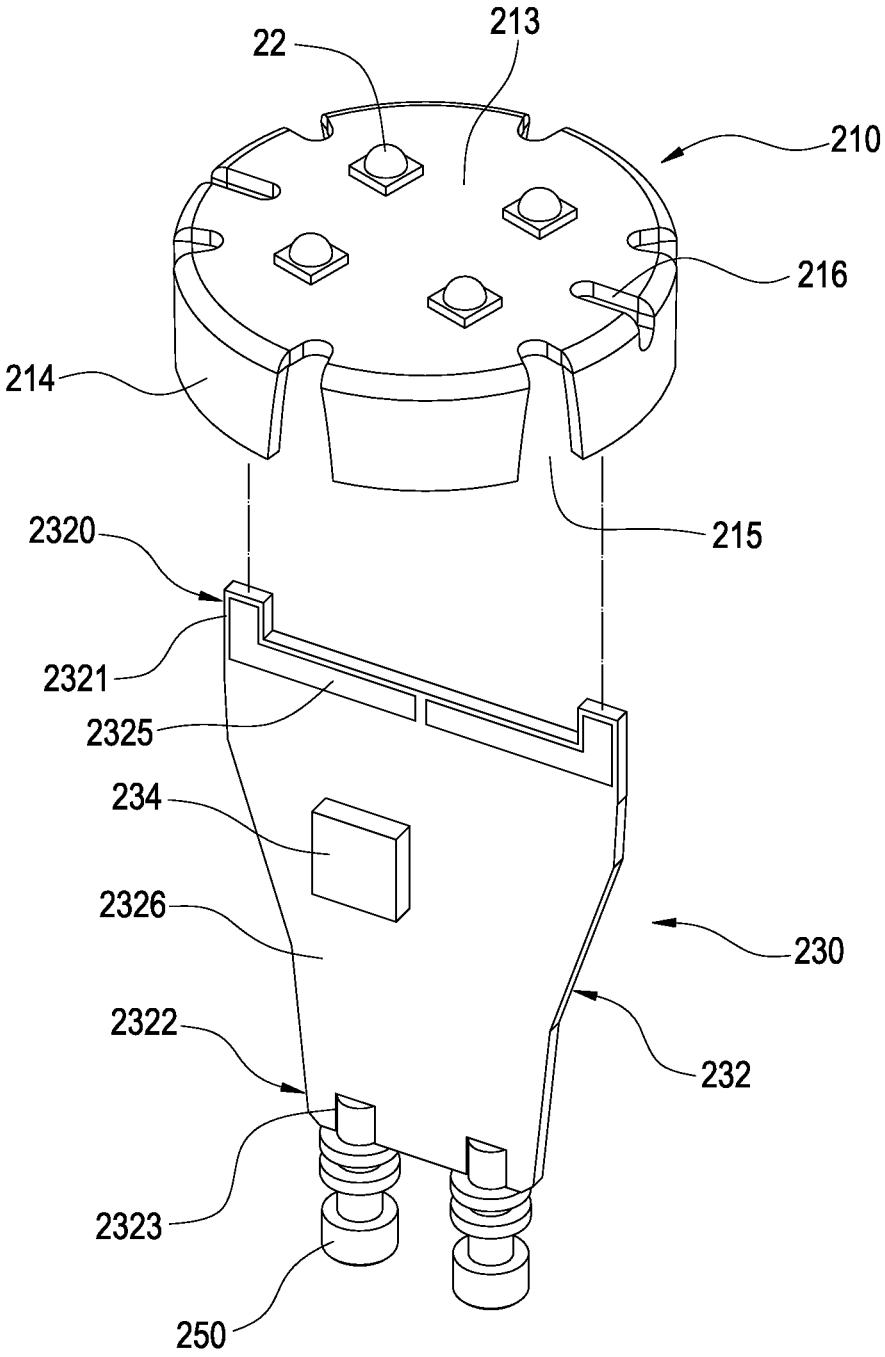
FIG. 8 is a partially exploded view of an illuminant device according to a third preferred embodiment of the present invention.
Figure 9:
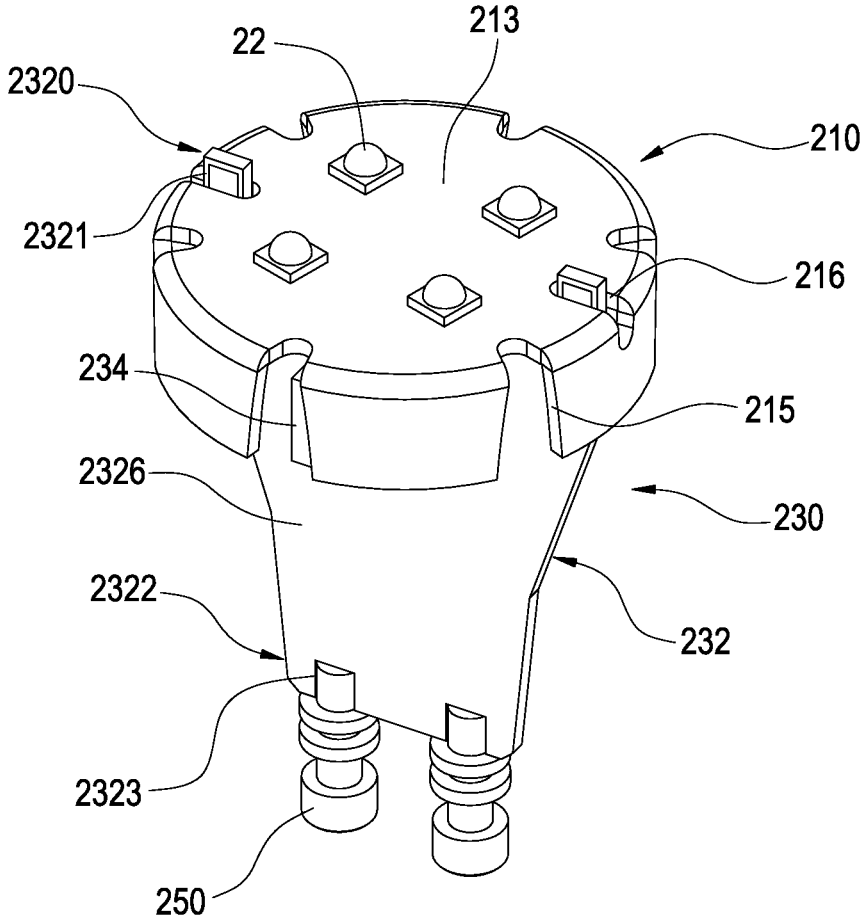
FIG. 9 is a partially assembled view of the illuminant device according to the third preferred embodiment of the present invention.
Figure 10:
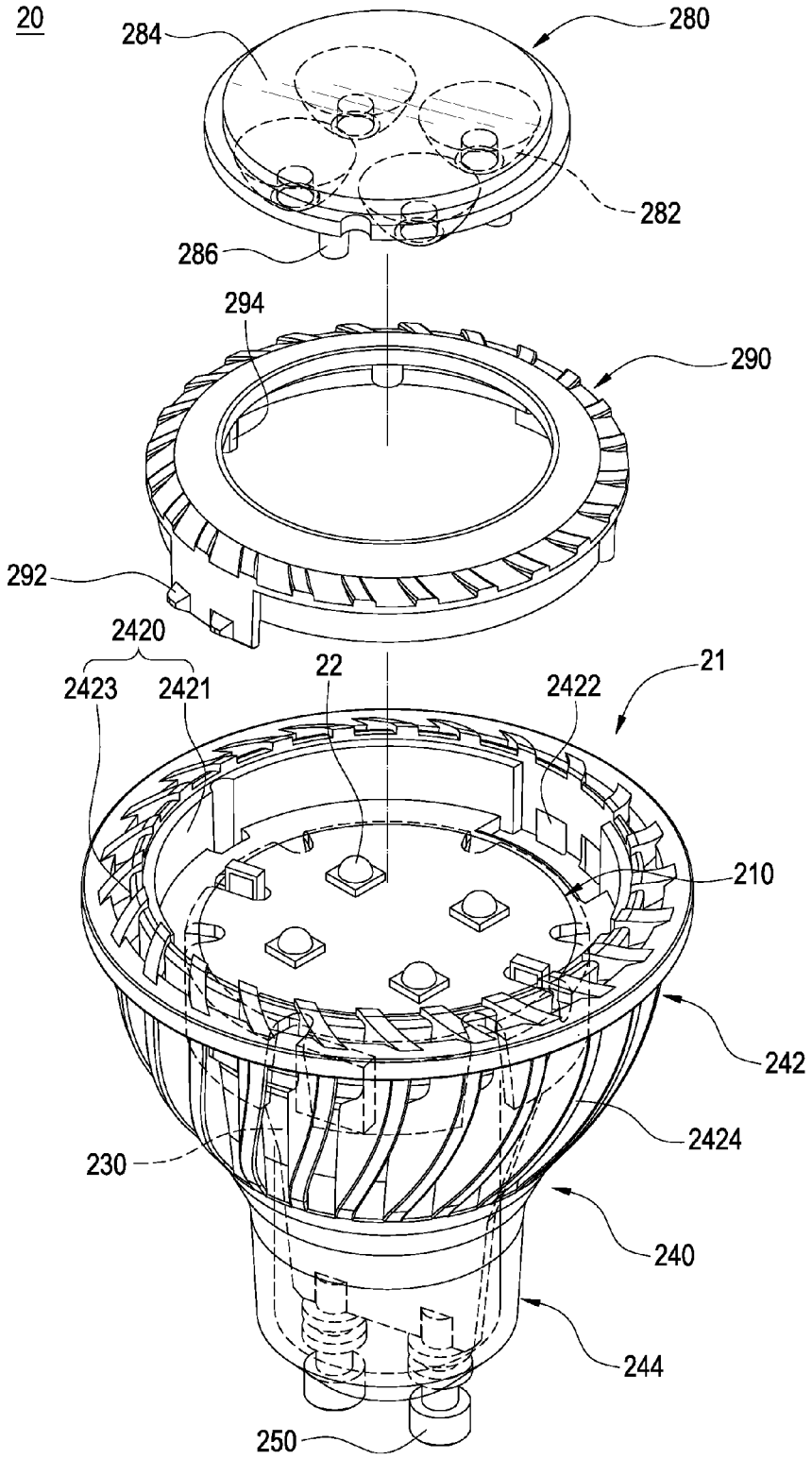
FIG. 10 is an exploded view of the illuminant device according to the third preferred embodiment of the present invention.
Figure 11:
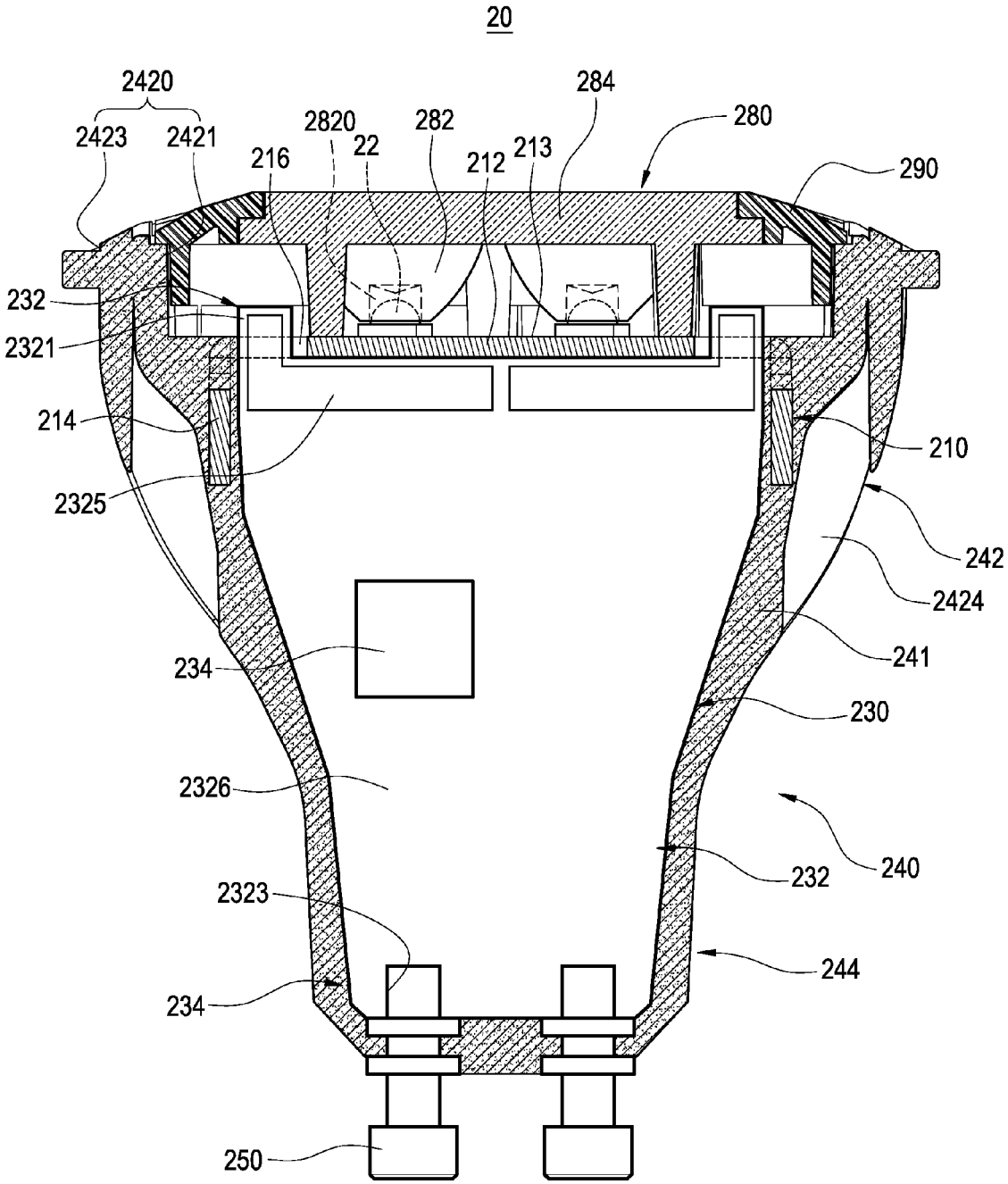
FIG. 11 is a cross-sectional view of the illuminant device according to the third preferred embodiment of the present invention.

Reference is made to FIG. 6 and FIG. 7, which are respectively an exploded view and a cross-sectional view of an illuminant device according to the second preferred embodiment of the present invention. The illuminant device 10*a* is similar to that of first preferred embodiment mentioned above, but the different is that the illuminant device 10*a* further includes an optical lens 180. The optical lens 180 is disposed on the first side 142 of the housing 140 and between the illuminant element 12 and the diffusing element 170 and covers the illuminant element 12 to change the light intensity distribution of light passing therethrough. The optical lens 180 may have functions of light-convergence or light-divergence according to light-emitting effect of the illuminant device 10*a*.

In this embodiment, the optical lens 180 has an optical axis I coincided to a light-emitting axis of the illuminant element 12. The optical lens 180 includes a permeable main body 181 made of glass, plastic or other light permeable material. The main body 181 has a light-incident part 182, a first light-emitting part 184 and a second light-emitting part 186. The light-incident part 182 has a bottom surface 1820 and a reflecting surface 1822. The bottom surface 1820 has a recess 1821, and the illuminant element 12 is disposed on the recess 1821. The reflecting surface 1822 is physically connected to the bottom surface 1820 and the first light-emitting part 184, and the distance located between the reflecting surface 1822 and the optical axis I is increased when the reflecting surface 1822 is gradually far away from the bottom surface 1820. The first light-emitting part 184 is physically connected to the reflecting surface 1822 and has a top surface 185. The top surface 185 is gradually close to the optical axis I when the top surface 185 is gradually close to the bottom surface 1820. The top surface 185 includes a plurality of first light-emitting surfaces 1842 and second light-emitting surfaces 1844 arranged in an interlaced manner. In this embodiment, the first light-emitting surface 1842 is substantially parallel to the bottom surface 1820, and the second light-emitting surface 1822 is substantially perpendicular to the bottom surface 1820 such that the first light-emitting part 184 is of stepwise. In addition, the length of the second light-emitting surfaces 1844 perpendicular to the bottom surface 1820 are progressively decreased when the second light-emitting surfaces 1844 are gradually close to the optical axis I. Therefore, the distance of light transmitting to the first light-emitting part 184 can be decreased to lower the losses of light transmitting inner the optical lens 180 and can further reduce the thickness and weight of the optical lens 180. In the practical application, changing the tilted angle located between a plane perpendicular to the optical axis I and the first light-emitting surface 1842 of the first light emitting part 184 of the optical lens 180 can effectively control travelling route of light emitted from the illuminant element 12.

The second light-emitting part 186 is physically connected to the top surface 185 and substantially located above the recess 1821. The second light-emitting part 186 is a Fresnel lens and may have the function of light-convergence or light-divergence.

Reference is made to FIG. 8, FIG. 9, FIG. 10 and FIG. 11, which are respectively a partially exploded view, a partially assembled view, an exploded view and a cross-sectional view of an illuminant device according to a third preferred embodiment of the present invention. The illuminant device 20 includes a lamp holder 21, a plurality of illuminant elements 22, an optical element 280 and a wedging element 290. The lamp holder 21 includes a MCPCB 210, a power driving unit 230 and a housing 240.

The MCPCB 210 is provided with conductive traces (not shown) and soldering pads (not shown) and includes a base 212 and a plurality of extending parts 214 extended from a circumference of base 212 in a bending forming manner and spaced from each other. The base 212 includes a plurality of holes 216, and in this embodiment, the number of the holes 216 are, for example, two. In the practical application, the MCPCB 110 is provides with a plurality of slots 215 by stamping process and then bending along the slots 215 such that the extending parts 214 are substantially perpendicular to the base 212.

The illuminant element 22 is mounted on an upper surface 213 of the base 212 and electrically connected to the MCPCB 210. In this embodiment, the number of the illuminant element 22 are, but not limited to, four, and preferably high power light emitting diodes (LEDs).

The power driving unit 230 includes a circuit board 232 and at least an electronic element 234 mounted on at least a plane 2326 of the circuit board 232. The circuit board 232 may be PCB and provided with conductive traces 2325 and soldering pads (not shown). In this embodiment, the conductive traces 2325 are, for example, two. The circuit board 232 includes a first end 2320 and a second end 2322 opposite to the first end 2320. The first end 2320 has a plurality of posts 2321 corresponding to the holes 216. In this embodiment, the posts 2321 are, for example, two. The posts 2321 are respectively penetrating the holes 216 such that an upper surface 213 of the MCPCB 210 are substantially perpendicular to the plane 2326 and the conductive traces 2325 are electrically connected to the MCPCB 230 through the posts 2321. The second end 2322 of the circuit board 232 includes a plurality of concaves 2323 used for disposed two conductive pins 250 of the illuminant device 20, the conductive pins 250 are electrically connected to the power driving unit 230.

The housing 240 is made of polymer material with high thermal conductivity and integrally-formed by injection molding. The housing 240 has advantages of light, easily manufacturing and high insulating effect. In addition, the polymer material includes a plurality of thermal conductive particles 241. The housing 240 has a first side 242 and a second side 244 opposite to the first side 242, the first side 242 is substantially of poculiform profile and has a circumferential wall 2420. An inner surface 2421 of the circumferential wall 2420 has a plurality of grooves 2422, and an external surface 2423 of the circumferential wall 2420 has a plurality of fins 2424 radially extended therefrom and physically connected thereon to increase effect of heat-dissipation. The MCPCB 210 is disposed on the first side 242 and the extending parts 214 are embedded within the housing 240. The second side 244 is physically connected to the first side 242 and is substantially of pipe shape, and the conductive pins 250 pass through the bottom of the second side 244 and adapted to the external socket (not shown).

The housing 240 covers the extending parts 214 of the MCPCB 210 and the power driving unit 230 such that the joining force between the MCPCB 210 and the house 240 is increased to prevent break from compression.

The optical element 280 is disposed on the first side 242 of the housing 240 and covers the illuminant elements 22. The optical element 280 includes a plurality of light-incident parts 282 and a light-emitting part 284. In this embodiment, the number of the light-incident parts 282 is equal to the number of the illuminant elements 22. The light-incident parts 282 are physically connected to the light-emitting part 284 and protruding toward a direction opposite to the light-emitting part 284. Each light-incident part 282 has a cavity 2820 and the illuminant elements 22 are disposed within the cavities 2820.

The optical lens 280 further includes a plurality of supporting elements 286, the supporting elements 286 touch the MCPCB 210 and support the optical element 280 above the illuminant elements 22.

The wedging element 290 having a plurality of tenons 292, the tenons 292 are respectively engaged with the grooves 2422 of the housing 240 to fasten the housing 240 and the optical lens 280.

Figure 12:
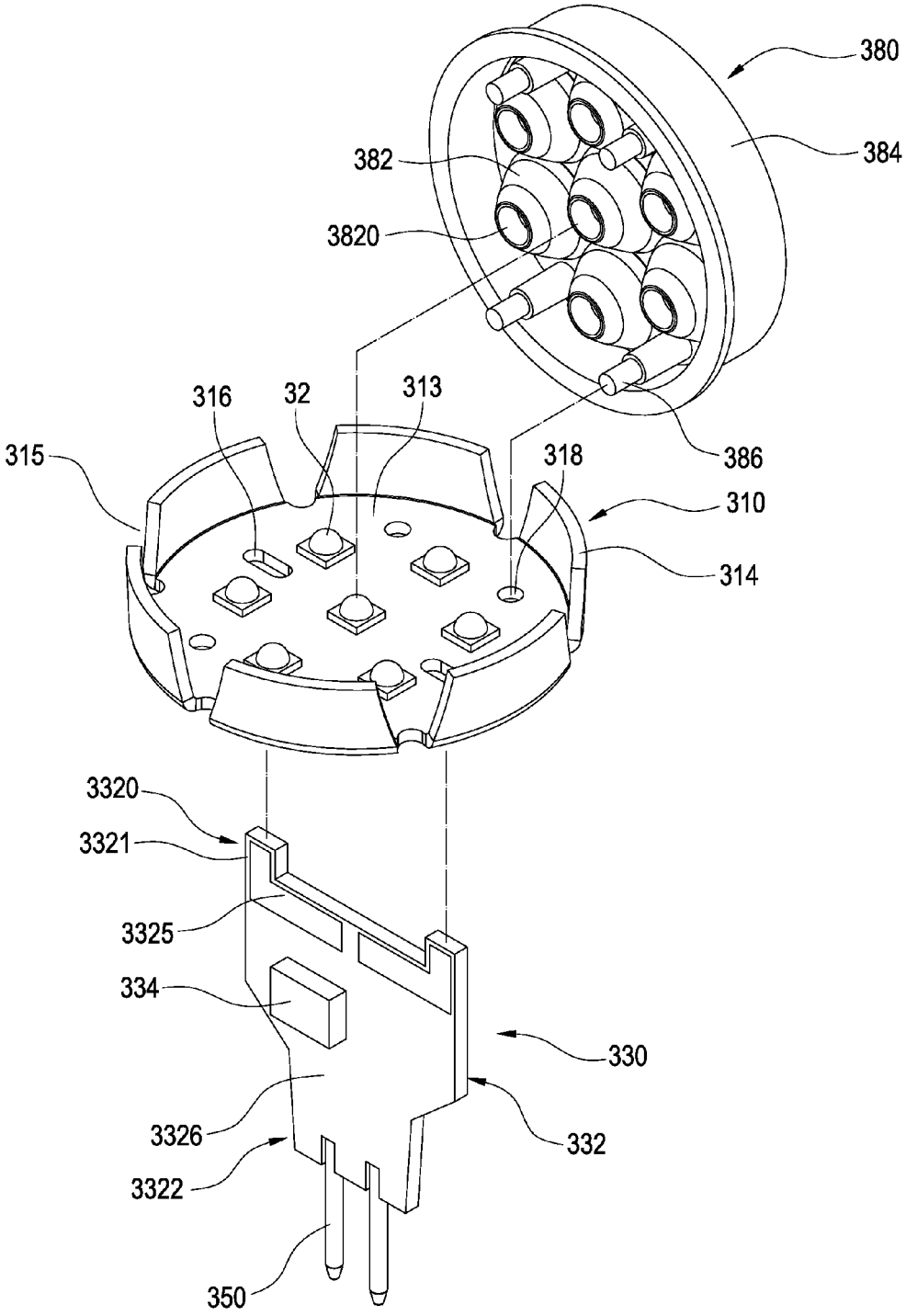
FIG. 12 is a partially exploded view of an illuminant device according to a fourth preferred embodiment of the present invention.
Figure 13:
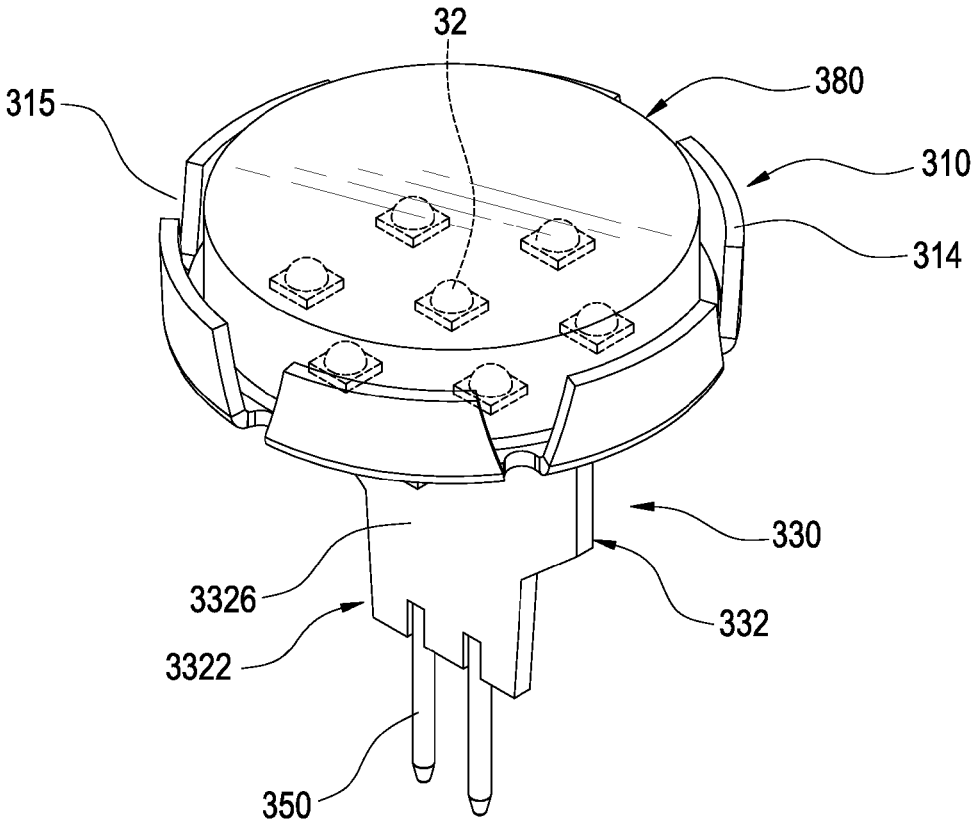
FIG. 13 is a partially assembled view of the illuminant device according to the fourth preferred embodiment of the present invention.
Figure 14:
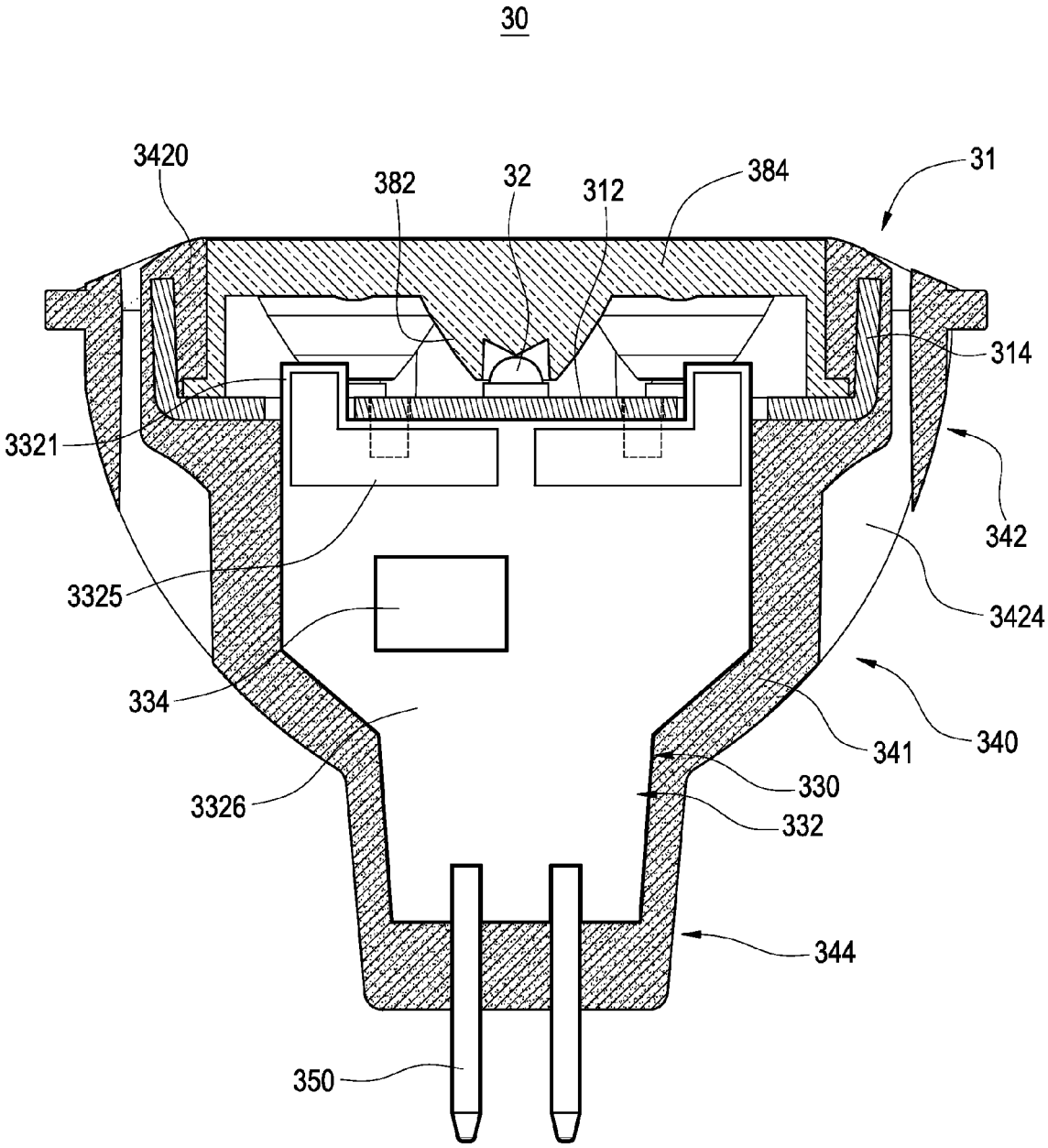
FIG. 14 is cross-sectional view of the illuminant device according to the fourth preferred embodiment of the present invention.

Reference is made to FIG. 12, FIG. 13 and FIG. 14, which are respectively a partially exploded view, a assembled view and a cross-sectional view of an illuminant device according to a fourth preferred embodiment of the present invention. In this embodiment, the illuminant device 30 is, for example, a MR 16 lamp. The illuminant device 30 includes a lamp holder 31 and at least an illuminant element 32. The lamp holder 31 includes a MCPCB 310, a power driving unit 330, a housing 340 and an optical element 380.

The MCPCB 310 includes a base 312 and a plurality of extending parts 314 extended from a circumference of base 312 in a bending forming manner and spaced from each other. In this embodiment, the extending parts 314 are substantially perpendicular to the base 312. The base 312 includes a plurality of holes 316 and openings 318. In this embodiment, the holes 316 are, for example, two, and the openings 318 are, for example, four.

The illuminant element 32 is mounted on an upper surface 313 of the base 312 and electrically connected to the MCPCB 310. In this embodiment, the number of the illuminant elements 32 is, but not limited to, seven, and preferably high power LEDs.

The power driving unit 330 includes a circuit board 332 and at least an electronic element 334 mounted on at least a plane 3326 of the circuit board 332. The electronic element 334 is, for example, power converter, active element or passive element. The circuit board 332 is preferably PCB and provided with conductive traces 3325 and soldering pads (not shown). In this embodiment, the conductive traces 3325 are, for example, two.

A first end 3320 of the circuit board 332 includes a plurality of the posts 3321, and in this embodiment, the number of the posts 3321 are, for example, two. The posts 3321 penetrates the holes 316, such that the plane 3326 is substantially perpendicular to an upper surface 313 of the MCPCB 310, and the conductive traces 3325 are electrically connected to the MCPCB 310 through the posts 3321.

The optical element 380 includes a plurality of light-incident parts 382, a light-emitting part 384 and a plurality of wedging parts 386. The light-incident parts 382 are physically connected to the light-emitting part 384 and arc-protruded toward a direction opposite to the light-emitting part 384. Each light-emitting part 382 has a cavity 3820, and the illuminant elements 32 are disposed within the cavities 3820, respectively. In this embodiment, the number of the light-emitting parts 382 is equal to the number of the illuminant elements 32. The wedging parts 386 are respectively corresponding to the openings 318 and number of the wedging parts 386 is equal to number of the openings 318. In this embodiment, the number of the wedging parts 386 are, for example, four. The wedging parts 386 are engaged with the openings 318 such that the optical element 380 is assembled with the MCPCB 310.

The housing 340 is made of polymer material with high thermal conductivity and integrally-formed by injection molding. The housing 340 has advantages of light, easily manufacturing and high insulating effect. The polymer material includes a plurality of thermal conductive particles 341. The housing 340 covers the extending parts 314, the power driving unit 330 and the optical element 380 such that the joining force between the MCPCB 310, the optical lens 380 and the house 340 is increased to prevent break from compression. A first side 342 of the housing 340 is substantially of poculiform profile and has a circumferential wall 3420, an external surface 3423 of the circumferential wall 3420 has a plurality of fins 3424 radially extended therefrom and physically connected thereon to increase effect of heat-dissipation. The MCPCB 310 is disposed on the first side 342 and the extending parts 314 are embedded within the housing 340. The optical element 380 is also disposed on the first side 342 and covers the illuminant elements 32. A second side 344 of the housing 340 is opposite to the first side 342 and physically connected to the first side 342 and is substantially of pipe-shape. A plurality of conductive pins 350 pass through the bottom of the second side 344 and electrically connected to the circuit board 332. In this embodiment, the conductive pins 350 are corresponding to connecting pins of MR 16 lamp.

The process of manufacturing the illuminant device 30 is described as below: first, forming a plurality of slots 315 spaced from each other on the MCPCB 310 by stamping process and bending the MCPCB 310 to form a base 312 and a plurality extending parts 314, and forming a plurality of holes 316 and openings 318 on the base 312 in the meanwhile. After that, assembling a plurality of posts 3321 of a circuit board 332 of a power driving unit 330 with the holes 316 of a MCPCB 310 and electrically connected the MCPCB 310 and the circuit board 332.

After that, mounting a plurality of illuminant elements 32 on the base 312 and electrically connecting to the MCPCB 310. Engaging wedging parts 386 of an optical element 380 with the openings 318, respectively, such that the optical lens 380 is fastened on the base 312 of the MCPCB 310.

Finally, embedding the assembled MCPCB 310 and the power driving unit 330 into an injection mold and forming a housing 340 outside the extending parts 314 of the MCPCB 310, the power driving unit 130 and the optical lens 380. Therefore the housing 340 can directly cover the extending parts 314 of the MCPCB 310, the power driving unit 330 and the optical lens 380.

Figure 15:
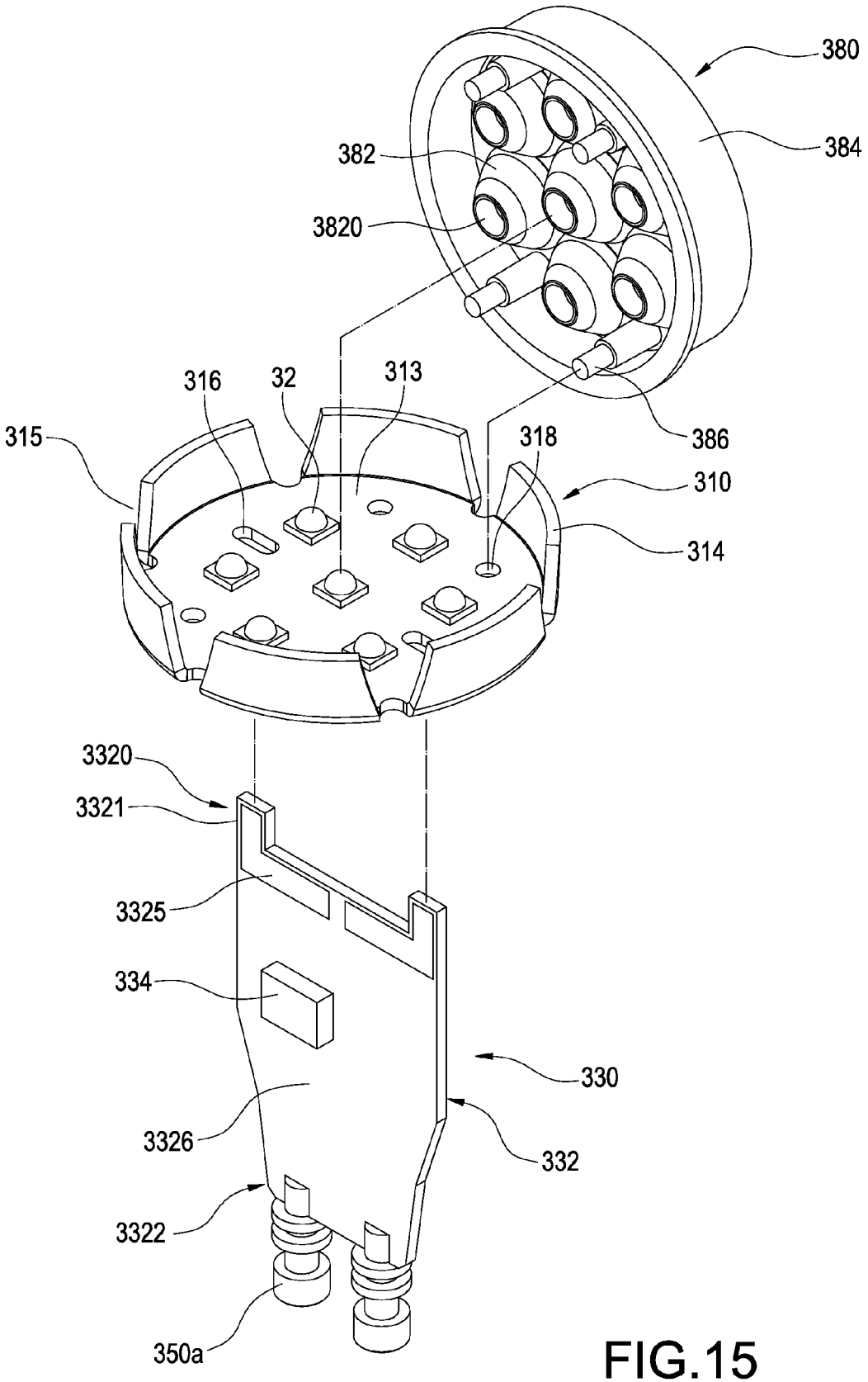
FIG. 15 is a partially exploded view of the illuminant device according to a fifth preferred embodiment of the present invention.
Figure 16:
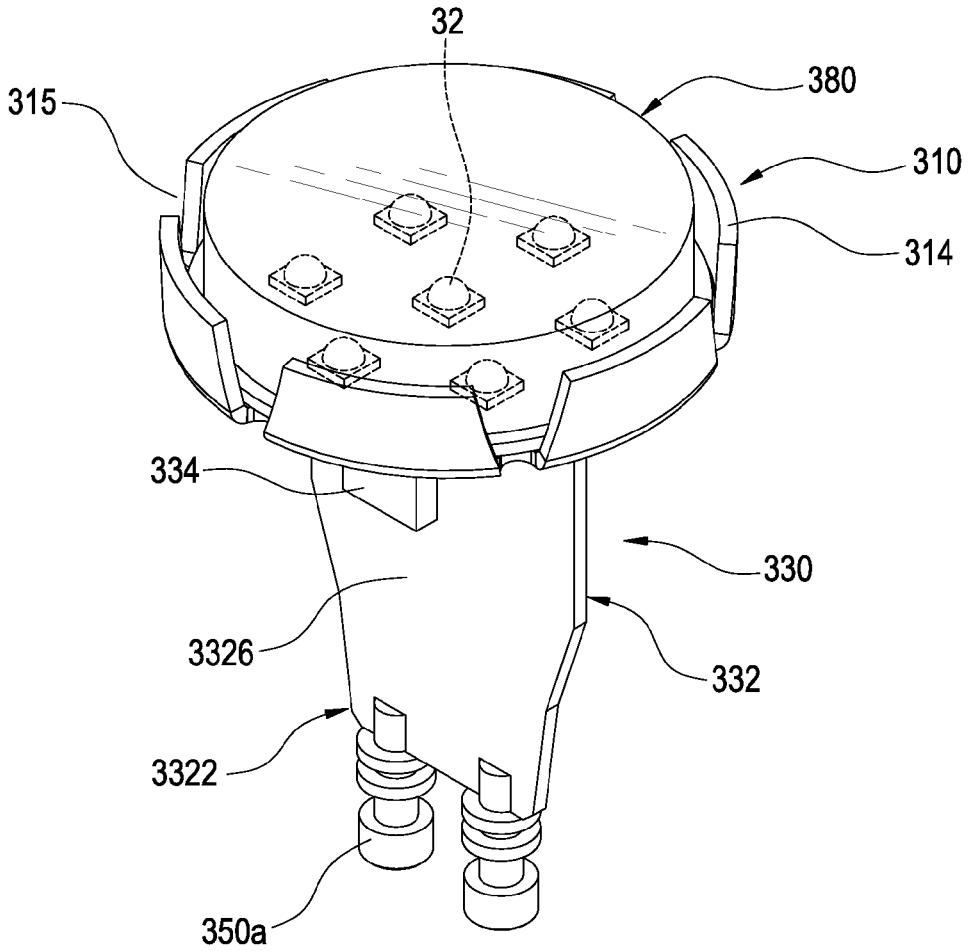
FIG. 16 is a partially assembled view of an illuminant device according to the fifth preferred embodiment of the present invention.
Figure 17:
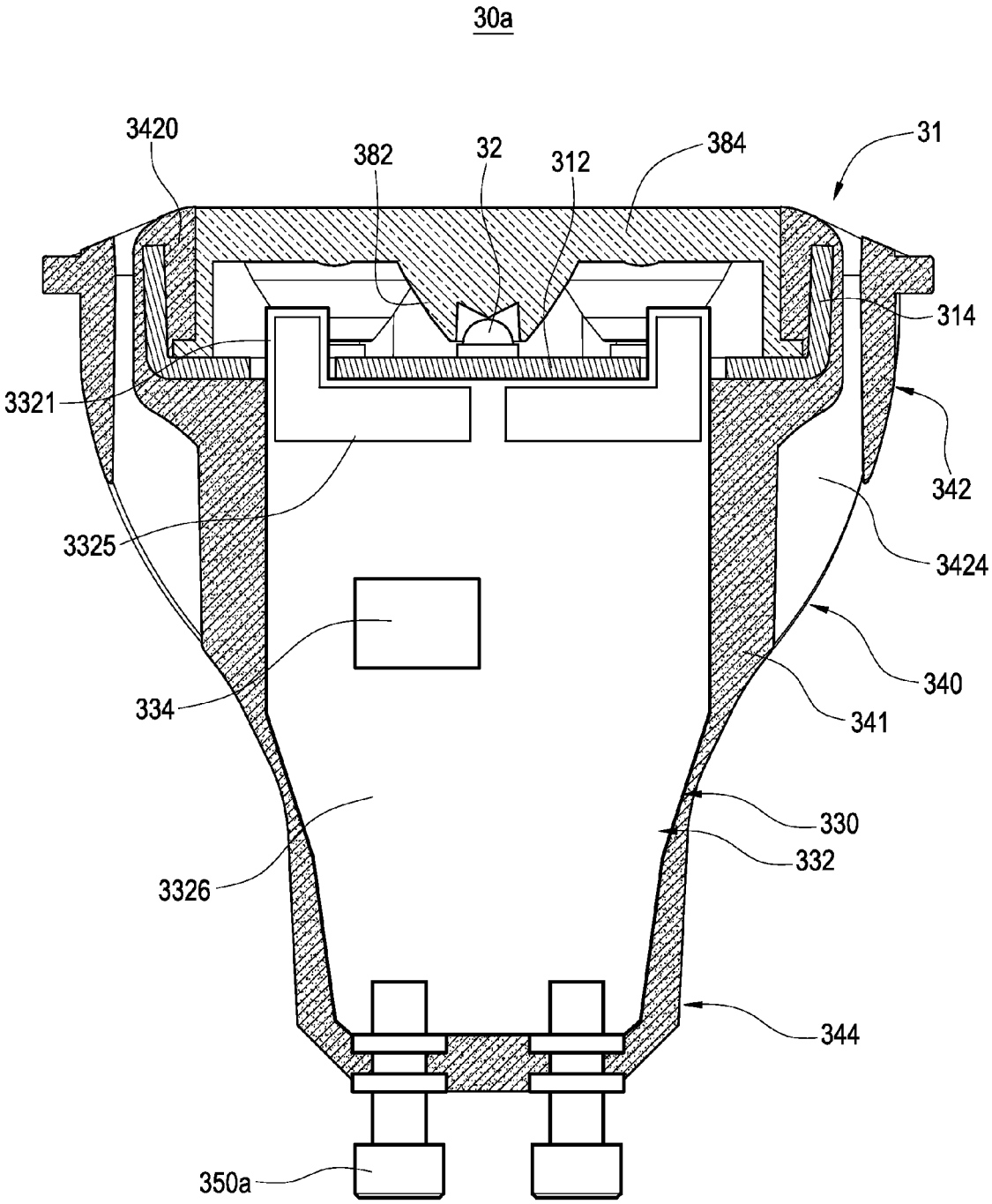
FIG. 17 is a cross-sectional view of the illuminant device according to the fifth preferred embodiment of the present invention.

Reference is made to FIG. 15, FIG. 16 and FIG. 17, which are respectively a partially exploded view, a partially assembled view and a cross-sectional view of an illuminant device according to a fifth preferred embodiment of the present invention. The illuminant device **30*a* is similar to that of fourth preferred embodiment mentioned above, but the different is that the conductive pins 350*a* of the illuminant device 30*a*** are corresponding to conductive pins of GU10 lamp for adapting into socket of GU5.3 or GX5.3. However, the sockets mentioned above are used for demonstration and is not limitation of the claim scope of the present invention.

To sum up, in the present invention, circuit board of the power driving unit is directly assembled with and electrically connected to the MCPCB such that can easily manufacturing process and lower manufacturing cost. In addition, the housing is made of polymer material with thermal conductive particle can effectively remove heat generated by the illuminant element and has advantages of easily manufacturing, light and high insulating effect. Furthermore, through bending the MCPCB and embedding the extending parts within the housing such that the housing can quickly remove heat generated by the illuminant element to prevent from intensity decreased, short life-time, wavelength drift or damage cause by operating with high temperature.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. An illuminant device comprising:

at least an illuminant element; and a lamp holder comprising:

a housing having a first side and a second side opposite to the first side;

a metal core printed circuit board (MCPCB) disposed in the first side of the housing and comprising a base and a plurality of extending portions extended from a circumference of the base in a bending forming manner and spaced from each other, the base having a plurality of holes, the extending parts entirely embedded within the housing, and the illuminant element disposed on a upper surface of the base and electrically connected to the base; and a power driving unit comprising a circuit board with a plurality of posts integrally protruded from a upper end thereof, the posts respectively penetrating the holes and electrically connected to the MCPCB.

2. The illuminant device in claim 1, further comprising a diffusing element disposed in the first side of the housing and covering the illuminant element.

3. The illuminant device in claim 2, wherein the diffusing element comprises a plurality of buckles engaged with a plurality of grooves formed on an inner circumferential wall of the housing, respectively.

4. The illuminant device in claim 2, further comprising an optical lens disposed beneath the diffusing element and covering the illuminant element.

5. The illuminant device in claim 4, wherein the optical lens having an optical axis and comprises:

a main body comprising:

a light-incident part comprising a bottom surface and a reflecting surface, the bottom surface having a recess, the reflecting surface physically connected to the bottom surface and the distance located between the reflecting surface and the optical axis is increased when the reflecting surface is gradually far away from the bottom surface, the illuminant element is disposed within the recess;

a first light-emitting part physically connected to the reflecting surface, the first light-emitting surface having a top surface and the top surface gradually close to the bottom surface when the top surface is gradually close to the optical axis; and a second light-emitting part physically connected to the top surface and substantially located above the recess.

6. The illuminant device in claim 5, wherein the top surface comprises a plurality of first light-emitting surfaces and second light-emitting surfaces arranged in an interlaced manner, the second light-emitting surfaces are substantially perpendicular to the bottom surface, the first light-emitting surfaces are substantially parallel to the bottom surface such that the first light-emitting part is of step shape.

7. The illuminant device in claim 4, wherein the optical lens comprises a plurality of light-incident parts and a light-emitting part, the light-incident parts are physically connected to the light-emitting part and protruded toward a direction opposite to the light-emitting part, each light-incident part has a cavity and the illuminant element is disposed inside the cavity.

8. The illuminant device in claim 1, where in the lamp holder further comprises an optical lens, the optical lens comprising a plurality of light-incident parts and a light-emitting part, the light-incident parts are physically connected to the light-emitting part and protruded toward a direction opposite to the light-emitting part, each light-incident part has a cavity and the illuminant element is disposed inside the cavity.

9. The illuminant device in claim 1, wherein the housing further comprises a plurality of fins radially extended from an external circumferential wall and physically connected thereon.

10. The illuminant device in claim 1, wherein the housing is made of thermoset plastic or thermoplasticity plastic.

11. The illuminant device in claim 1, wherein the housing comprises a plurality of thermal conductive particles with high thermal conductivity.

12. The illuminant device in claim 11, wherein the thermal conductive particles are metallic oxide powder, graphite powder or ceramic powder.

13. The illuminant device in claim 1, wherein a least a plane of the circuit board of the power driving unit is substantially perpendicular to the upper surface of the base.

14. The illuminant device in claim 8, further comprising a wedging element having a plurality of tenons, the tenons are engaged with a plurality of grooves formed on the housing, respectively.

15. A manufacturing method of a lamp holder comprising:

(a) penetrating a plurality of holes of a metal core printed circuit board (MCPCB) with a plurality of posts of a circuit board of a power driving unit, respectively, and electrically connecting the MCPCB and the power driving unit, wherein an illuminant element is disposed on a surface of the MCPCB and the plurality of posts are integrally protruded from an end of the circuit board; and (b) forming a housing outside the MCPCB and the power driving unit and partially covering the MCPCB and the power driving unit.

16. The manufacturing method of a lamp holder of claim 15, wherein the housing comprises a plurality of thermal conductive particles with thermal conductivity.

17. The manufacturing method of a lamp holder on claim 15, before step (a), further comprising a step (a0):

stamping a plurality of slots spaced from each other on the MCPCB and bending along the slots such that the MCPCB is formed a base and a plurality of extending parts.

18. The manufacturing method of a lamp holder of claim 15, after step (a) comprising a step (a1):

disposing an optical element on the MCPCB, the optical element having a plurality of wedging parts engaging with a plurality of openings formed on the MCPCB, and the housing partially covers the optical element.

* * * * *